US006179153B1

(12) United States Patent
Huang

(10) Patent No.: US 6,179,153 B1
(45) Date of Patent: Jan. 30, 2001

(54) TWO-CHAMBER CONTAINER WITH CHANGEABLE UPPER COVER

(76) Inventor: Ching-An Huang, 3F, No.6, Alley 70, Lane 113, Tung Hu Road, Nei Hu (114), Taipei (TW)

( * ) Notice: Under 35 U.S.C. 154(b), the term of this patent shall be extended for 0 days.

(21) Appl. No.: 09/390,640

(22) Filed: Sep. 7, 1999

(51) Int. Cl.[7] ..... B65D 25/00
(52) U.S. Cl. ..... 220/553; 215/6
(58) Field of Search ..... 220/553, 555, 220/503, 554; 215/6

(56) References Cited

U.S. PATENT DOCUMENTS 2,711,766 * 6/1955 Archer, et al. ..... 215/6 X
3,469,739 * 9/1969 Phillips ..... 215/6 X
3,590,989 * 7/1971 Wittwer ..... 215/6 X
5,388,729 * 2/1995 Gerringer ..... 215/6 X
5,487,486 * 1/1996 Meneo ..... 215/6 X
5,769,680 * 6/1998 Hoffman ..... 215/6 X
5,996,781 * 12/1999 Glaser et al. ..... 215/6 X

* cited by examiner

*Primary Examiner*—Steven Pollard
(74) *Attorney, Agent, or Firm*—Dougherty & Troxell

(57) ABSTRACT

A two-chamber container including an integrally injection-molded main body having an upward opened inner chamber and an downward opened outer chamber surrounding or below the inner chamber. The inner chamber has a first annular flange vertically upward extending along an outer periphery of its opening. The upward opening of the inner chamber may be selectively closed with an upper cover. The upper cover may be differently designed for the two-chamber container to provide different usage depending on actual need. But the upper cover always includes a second annular flange vertically downward extending along an inner periphery thereof, such that the second annular flange is tightly fitted in the first annular flange when the upper cover is closed into the upward opening of the inner chamber of the main body. A bottom plate is plastically welded to the downward opening of the outer chamber, so that a dual-liquid and floating ornaments may be contained in the outer chamber for display and decoration purpose.

4 Claims, 6 Drawing Sheets

TWO-CHAMBER CONTAINER WITH CHANGEABLE UPPER COVER

BACKGROUND OF THE INVENTION

The present invention relates to a two-chamber container, and more particular to a container having a main body to which differently designed upper covers with the same basic structure can be selectively closed depending on actual usage.

There are various kinds of differently designed containers available in the markets. Among these containers, there is one formed from multiple parts that are injection-molded from clear plastic material. These injection-molded parts are then connected to one another by ultrasonic welding. A part of the container so formed is used to contain creamy liquid that can be sucked for use through a suction head and an associated suction pipe, and another part of the container is used to contain a dual-liquid and floating ornaments to create additional decorative effect. A disadvantage of this multi-part container is it includes so many parts that it necessitates many molds for forming these parts and therefore higher manufacturing cost for the container. Another disadvantage of the container is it is uneasy to have controlled quality in respect of the ultrasonic welding of the complicate parts and therefore the high bad yield of the produced containers. The high manufacturing cost and the high bad yield all reduce the competitive ability of these multi-part containers in the markets. Moreover, such multi-part container has a main body that has been designed for use only to contain creamy liquid. That is, the container has only one single usage as a creamy liquid container without the possibility of serving as other similar series products, such as a toothbrush support, a mouth washing cup, etc. The container therefore can not be produced in a more effective manner to reduce the cost thereof.

SUMMARY OF THE INVENTION

A primary object of the present invention is to provide a two-chamber container that includes an integrally injection-molded main body having an upward opened inner chamber and a downward opened outer chamber surrounding or below the inner chamber. The inner chamber has a first annular flange vertically upward extending along an outer periphery of its opening. The upward opening of the main body may be selectively closed with an upper cover. The upper cover may be differently designed for the container to provide different usage depending on actual need. But the upper cover always includes a second annular flange vertically downward extending along an inner periphery thereof, such that the second annular flange is tightly fitted in the first annular flange when the upper cover is closed into the upward opening of inner chamber of the main body. A bottom plate is plastically welded to the downward opening of the outer chamber, so that a dual-liquid and floating ornaments may be contained in the outer chamber for display and decoration purpose.

DETAILED DESCRIPTION OF THE PREFERRED EMBODIMENTS

Figure 1:
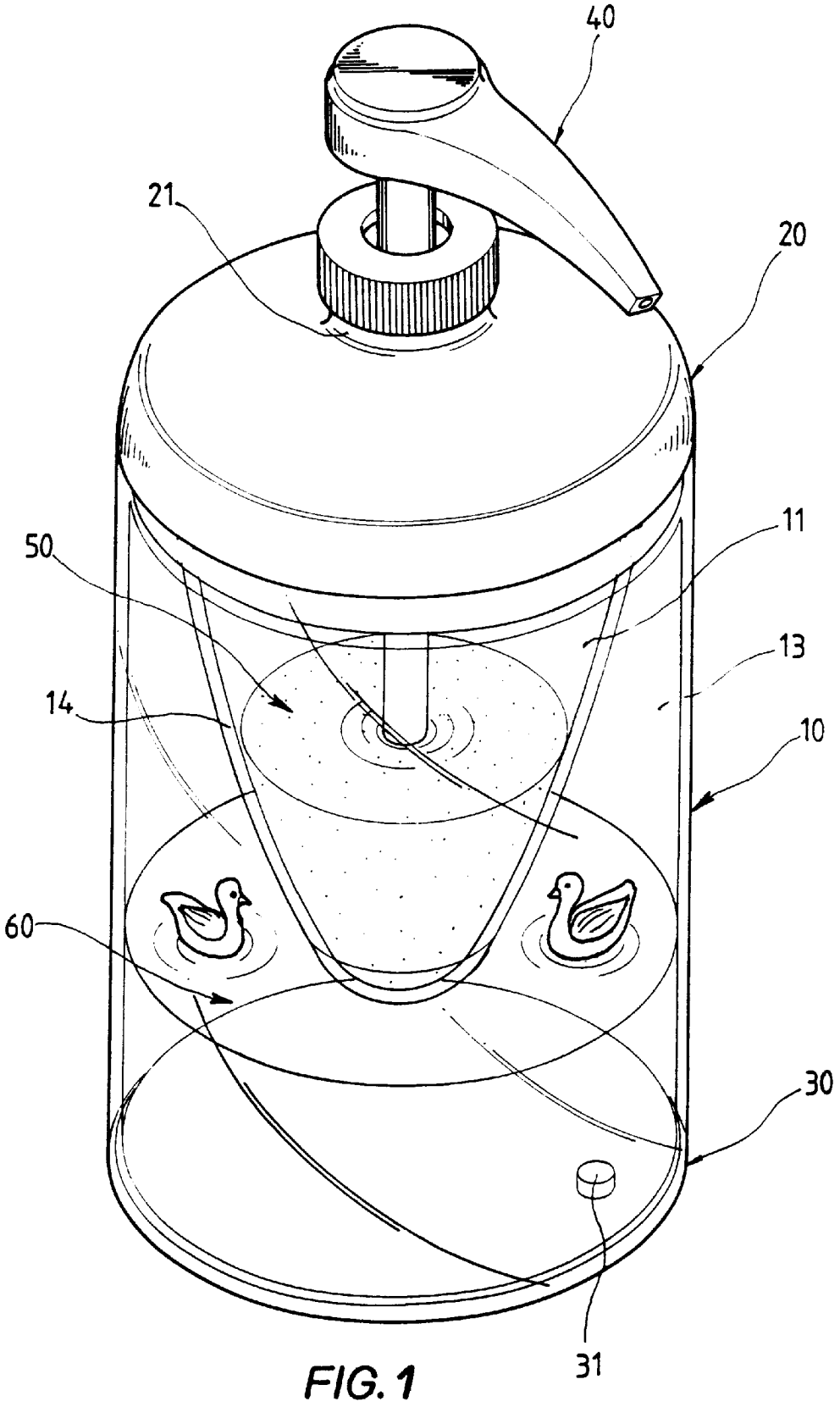
FIG. 1 is an assembled perspective of a two-chamber container according to a preferred embodiment of the present invention.
Figure 2:
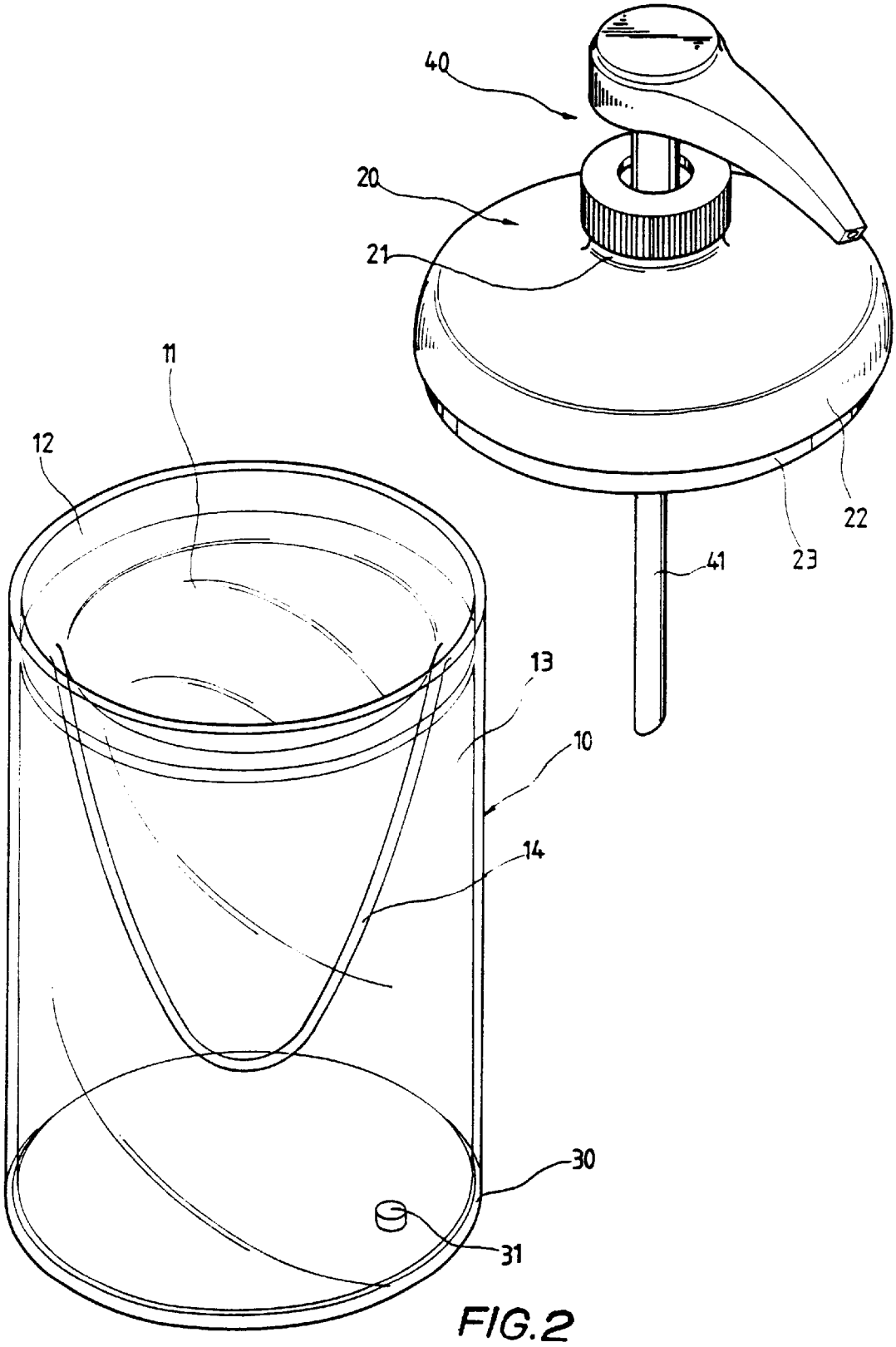
FIG. 2 is an exploded perspective of the two-chamber container of FIG. 1.
Figure 3:
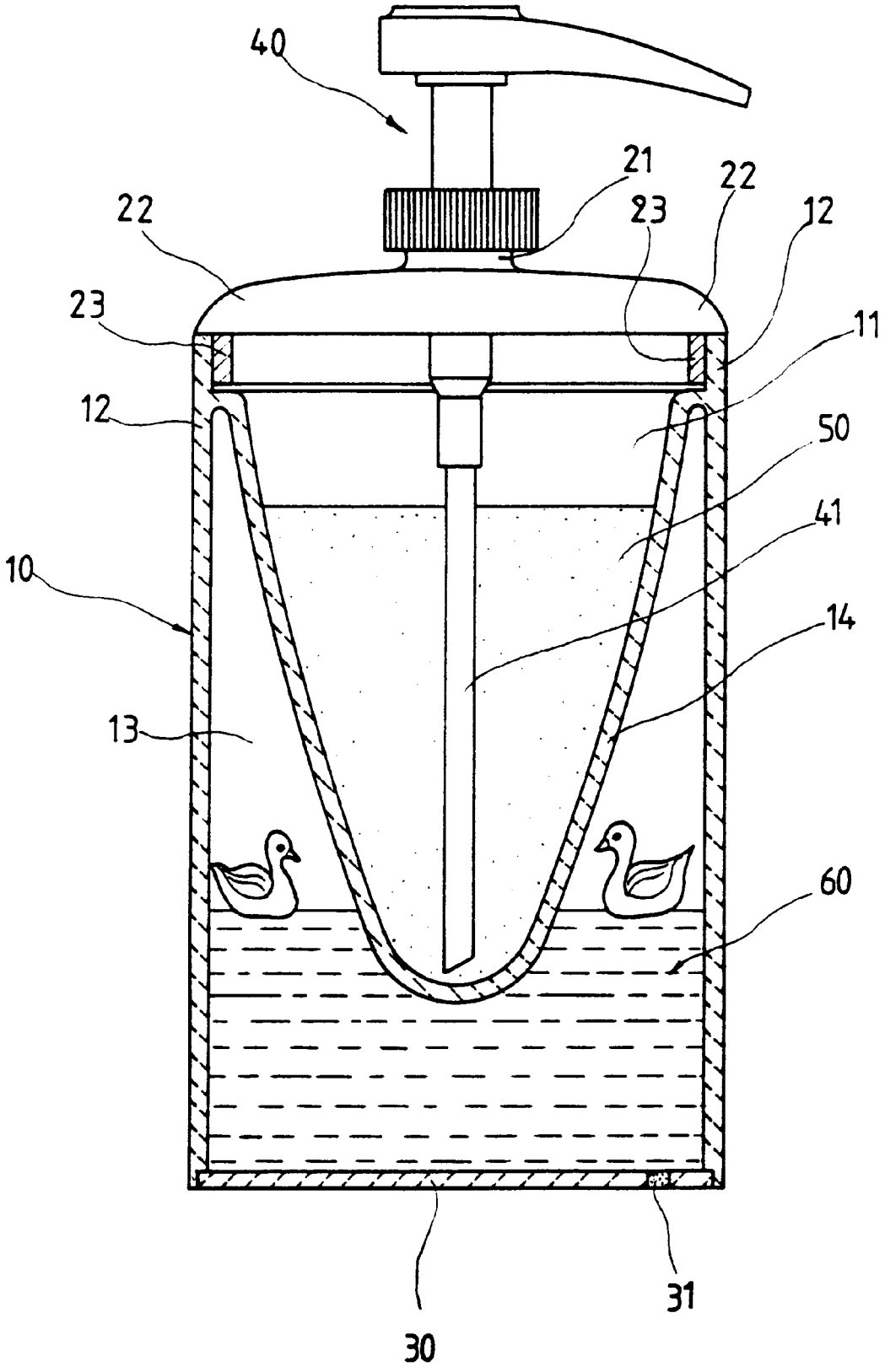
FIG. 3 is a vertical sectional view of the two-chamber container of FIG. 1.

Please refer to FIGS. 1, 2 and 3 in which a two-chamber container according to a preferred embodiment of the present invention is shown. The two-chamber container mainly includes a main body 10, an upper cover 20, and a bottom plate 30.

The main body 10 is formed by injection molding of a clear plastic material into a cylindrical body having an upward opened inner conic chamber 11. An outer peripheral wall of the main body 10 upward extended from an upper edge of the inner conic chamber 11 to form a first annular flange 12. The first annular flange 12 and the upper edge of the inner conic chamber 11 together define an inside stepped shoulder portion between them. The rest portion of the main body 10 outside the inner conic chamber 11 forms a downward opened outer chamber 13. The inner conic chamber 11 and the outer chamber 13 are separated from each other by an intermediate wall 14.

The upper cover 20 is an integrally molded member having an externally threaded tubular opening 21 formed at a top center thereof for engaging with a set of suction head 40. The suction head 40 is a commercially available product. The upper cover 20 has an expanded bottom opening 22. A second annular flange 23 vertically downward extends from and along an inner lower edge of the expanded bottom opening 22, such that an outside stepped shoulder portion is defined between the expanded bottom opening 22 and the second annular flange 23. The outside and the inside shoulder portions are so sized that the second annular flange 23 is tightly fitted in the first annular flange 12 when the upper cover 20 is closed onto a top opening of the inner chamber of the main body 10, making an outer surface of the upper cover 20 flush with an outer surface of the first annular flange 12.

The inner conic chamber 11 may be used to contain creamy liquid 50, for example, that may be sucked for use through the suction head 40 and an associated suction pipe 41.

The bottom plate 30 is connected to a bottom opening of the outer chamber 13 through plastic welding. The bottom plate 30 is provided with an injection orifice 31 through which a dual-liquid may be injected into the outer chamber 13 to float ornaments 60 disposed in the outer chamber in advance for decoration purpose. Therefore, the container according to the present invention can be used as an ornament, too.

Figure 4:
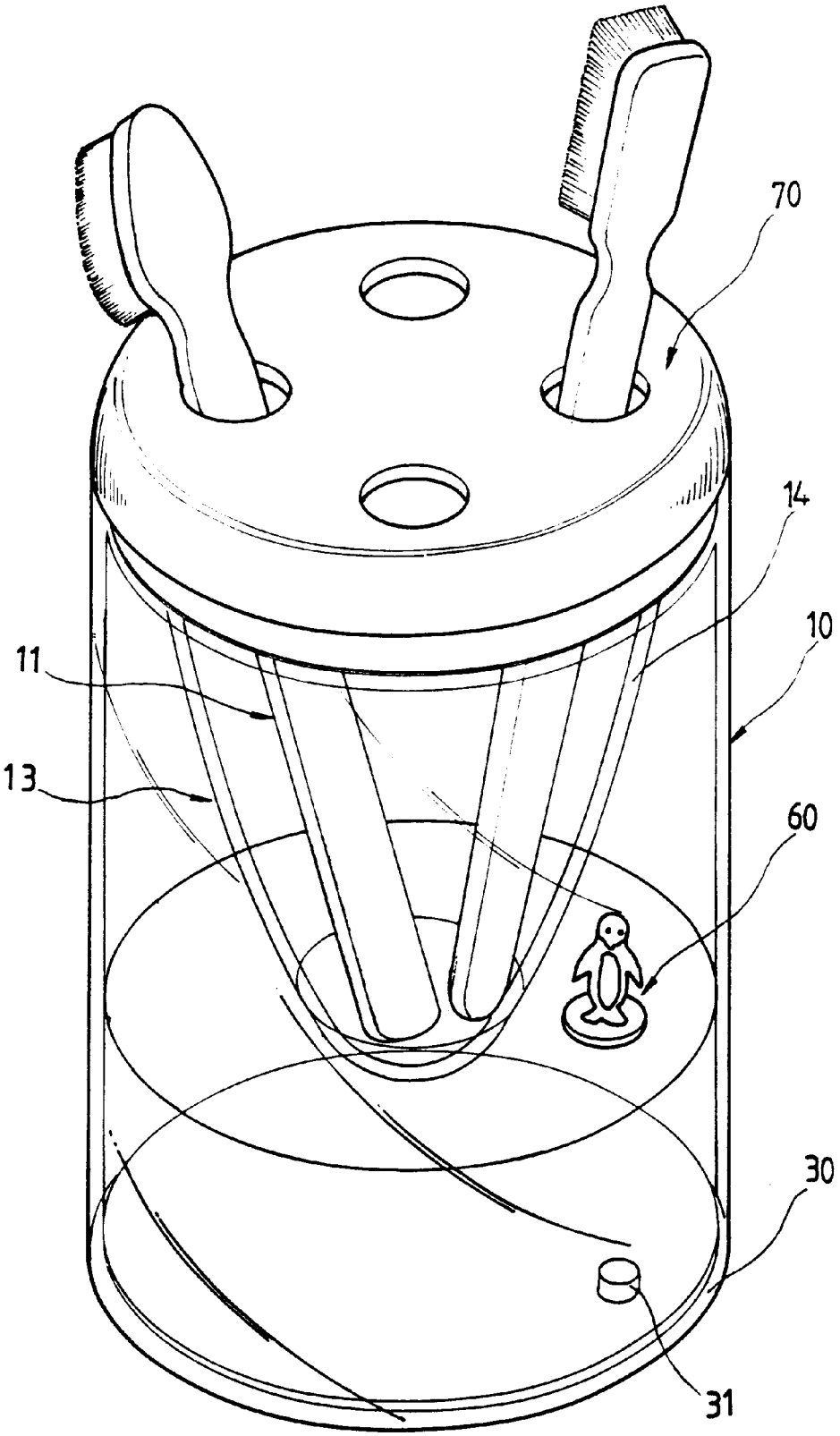
FIG. 4 is an assembled perspective of a two-chamber container according to a second embodiment of the present invention.

With the same tight fit relation between the upper cover 20 and the main body 10 achieved through the first and the second annular flange 12 and 23, the upper cover 20 may be selectively shaped differently to enable the main body 10 to provide diversified functions. FIG. 4 illustrates a two-chamber container having the main body 10 and a simplified upper cover 70 that has a generally flat head and is provided with several holes. The upper cover 70 is also closed onto the upper opening of the inner conic chamber 11 in a tight fit and flush manner. The combination of the upper cover 70 with the main body 10 forms an ornamental toothbrush support. As a matter of fact, the creamy liquid container and the toothbrush support all are products for use in bathroom but might have different sale quantities (there are various types of creamy liquid and a large quantity of containers would be needed for them). The present invention allows the main body 10 having the dual-liquid floating ornaments 60 common to creamy liquid containers and toothbrush supports to be separately manufactured in the manner of mass production to reduce the manufacture cost thereof. As to the upper cover, it may be manufactured depending on actual market demand to have different shape based on the same tight-fit structural design and therefore meet different demands. In other words, the present invention provides a two-chamber container that allows separate manufacture of its main body and its upper cover to facilitate planned production depending on actual market demands.

Figure 5:
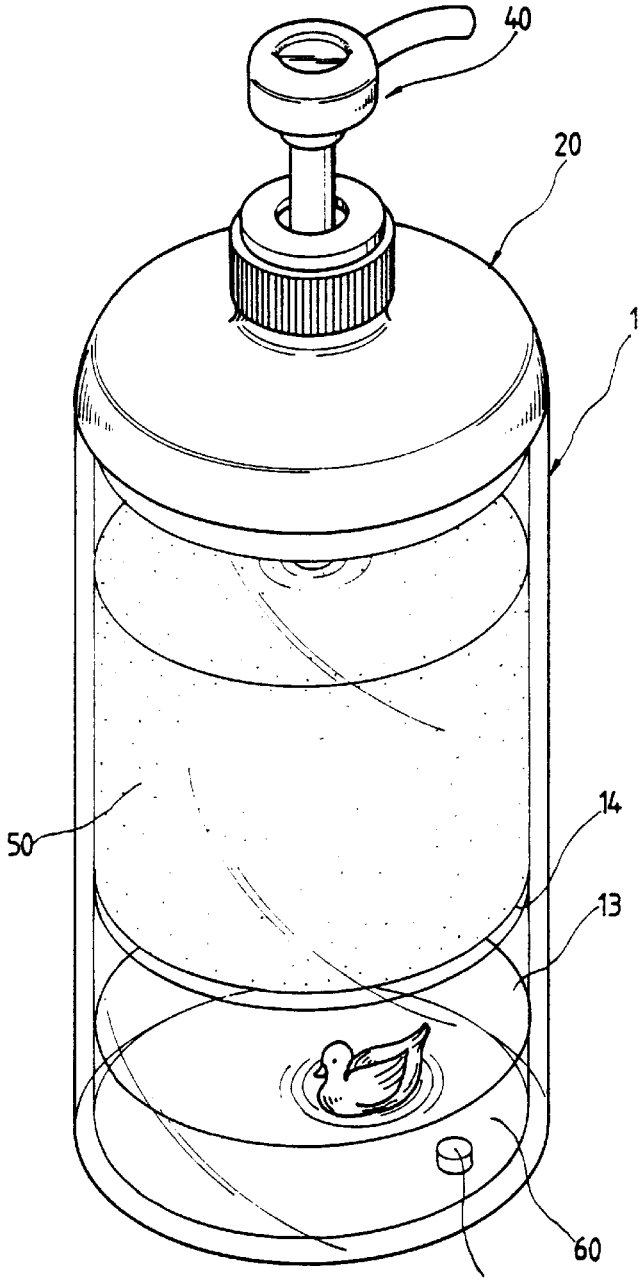
FIG. 5 is an assembled perspective of a two-chamber container according to a third embodiment of the present invention.
Figure 6:
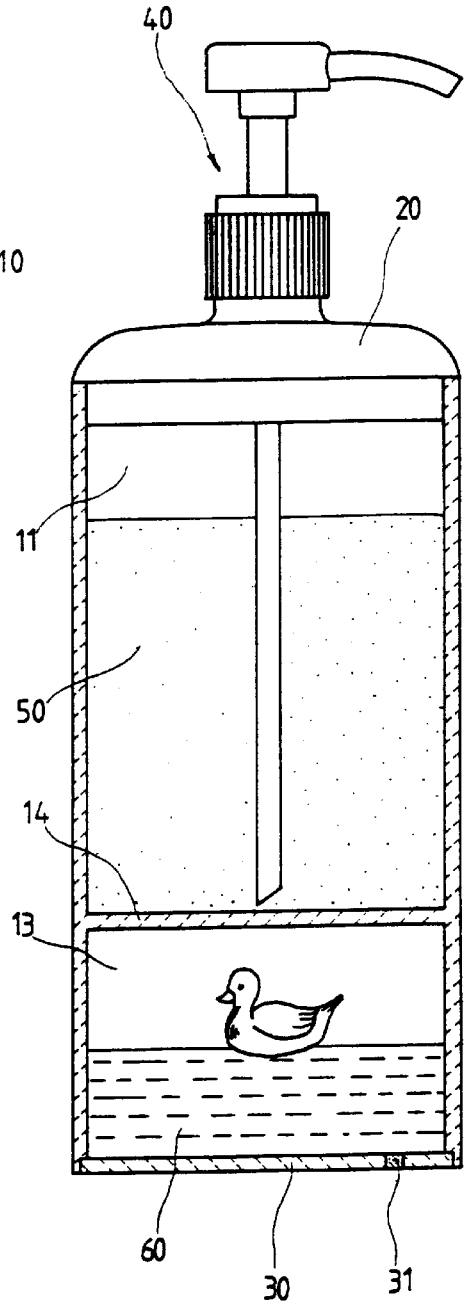
FIG. 6 is a vertical sectional view of the two-chamber container of FIG. 5.
Figure 9:
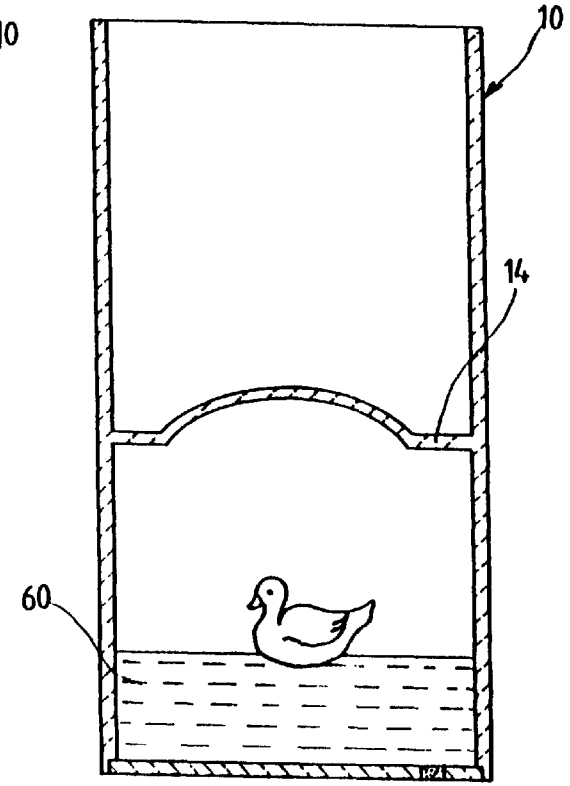
FIG. 9 is a vertical sectional view of a two-chamber container according to a sixth embodiment of the present invention.
Figure 8:
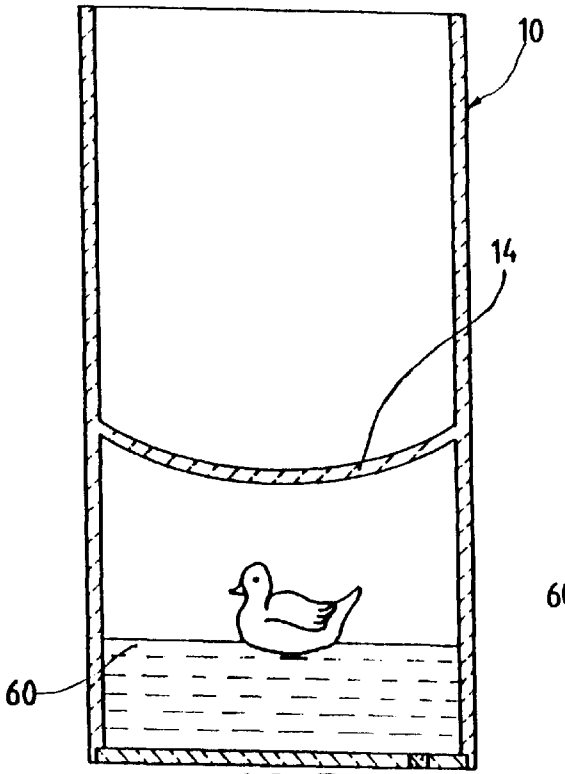
FIG. 8 is a vertical sectional view of a two-chamber container according to a fifth embodiment of the present invention.
Figure 7:
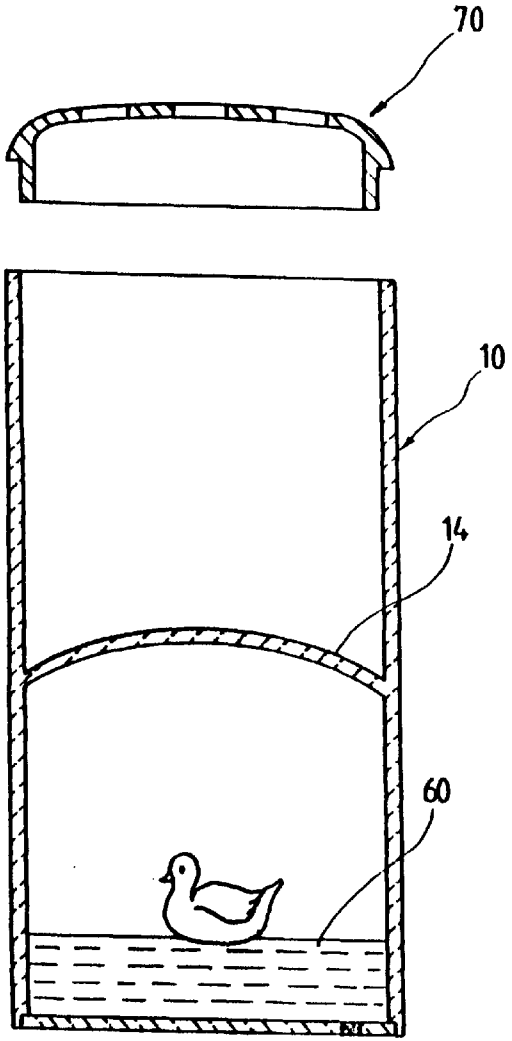
FIG. 7 is a vertical sectional view of a two-chamber container according to a fourth embodiment of the present invention.

The main body 10 of the two-chamber container according to the present invention may also be structurally simplified to create diversified designs. Please refer to FIGS. 5 and 6 that show a two-chamber container having a main body 10 including an inner chamber 11 and an outer chamber 13 that are separated from each other by a straight intermediate plate 14. The upper cover 20 may also have different shape to meet actual need. FIG. 7 illustrates a two-chamber container serving as a toothbrush support that has a main body 10 with a convex intermediate plate 14 and a flat upper cover 70. FIG. 8 illustrates a two-chamber container having a main body 10 with a concave intermediate plate 14. FIG. 9 illustrates a two-chamber container having a main body 10 with an intermediate plate 14 having an arched central portion. Both the two-chamber containers of FIGS. 8 and 9 may have or have not an upper cover closed thereonto. In the latter case, the two-chamber container may serve as a mouth-washing cup.

What is claimed is:

1. A two-chamber container comprising a main body, an upper cover selectively closed onto said main body, and a bottom plate connected to a bottom of said main body through plastic welding;

said main body being integrally formed by injection molding of a clear plastic material into an inner chamber and an outer chamber separated from each other by an intermediate plate, said inner chamber having an upward opening, around an outer periphery of which a first annular flange vertically upward extending, said outer chamber having an downward bottom opening to which said bottom plate is connected through plastic welding; and said upper cover being an integrally molded member having a downward opening, around an inner periphery of which a second annular flange vertically downward extending; and said first and said second annular flanges being so sized that said second annular flange is tightly fitted in said first annular flange when said upper cover is closed into said upward opening of said inner chamber of said main body, making an outer surface of said upper cover flush with an outer surface of said first annular flange;

a creamy liquid disposed in said inner chamber and a second liquid and a plurality of floating ornaments disposed in said outer chamber whereby said second liquid and said plurality of floating ornaments form a decorative display.

2. A two-chamber container as claimed in claim 1, wherein said intermediate plate may have a shape selected from the group consisting of at least conic, straight, convex, concave, and centrally arched shapes.

3. A two-chamber container as claimed in claim 1, wherein said upper cover includes an externally threaded tubular opening provided at a top center thereof for engaging with a commercially available suction head and an associated suction pipe.

4. A two-chamber container as claimed in claim 1, wherein said upper cover has an appearance differently designed to meet actual usage without changing a basic structure of having said second annular flange for tightly fitting in said inner chamber of said main body and flushing with said outer surface of said first annular flange.

* * * * *